US010145020B2

(12) United States Patent
Elangovan et al.

(10) Patent No.: US 10,145,020 B2
(45) Date of Patent: Dec. 4, 2018

(54) HYDROGEN UTILIZATION AND CARBON RECOVERY

(71) Applicant: CERAMATEC, INC., Salt Lake City, UT (US)

(72) Inventors: Singaravelu Elangovan, South Jordan, UT (US); Mukund Karanjikar, West Valley City, UT (US)

(73) Assignee: Ceramatec, Inc., Golden, CO (US)

( * ) Notice: Subject to any disclaimer, the term of this patent is extended or adjusted under 35 U.S.C. 154(b) by 0 days.

(21) Appl. No.: 14/474,843

(22) Filed: Sep. 2, 2014

(65) Prior Publication Data

US 2015/0060296 A1 Mar. 5, 2015

Related U.S. Application Data

(60) Provisional application No. 61/872,184, filed on Aug. 30, 2013.

(51) Int. Cl.

| | |
|---|---|
| ***C25B 9/08*** | (2006.01) |
| ***C25B 11/04*** | (2006.01) |
| ***C25B 9/00*** | (2006.01) |
| ***C25B 9/10*** | (2006.01) |
| ***C25B 1/00*** | (2006.01) |
| ***C25B 3/04*** | (2006.01) |
| ***C25B 13/04*** | (2006.01) |
| ***C25B 1/02*** | (2006.01) |

(52) U.S. Cl.

CPC ..... *C25B 9/10* (2013.01); *C25B 1/00* (2013.01); *C25B 1/02* (2013.01); *C25B 3/04* (2013.01); *C25B 13/04* (2013.01); *C25B 11/0463* (2013.01)

(58) Field of Classification Search

CPC .. C25B 9/08; C25B 3/04; C25B 11/04; C25B 9/00

USPC ..... 204/242, 252; 205/462, 555

See application file for complete search history.

(56) References Cited

U.S. PATENT DOCUMENTS

| | | | | |
|---|---|---|---|---|
| 4,341,608 | A | 7/1982 | St. John | |
| 8,366,902 | B2 * | 2/2013 | Hawkes | C10J 3/00 205/628 |
| 8,993,200 | B2 * | 3/2015 | Liu et al. | 429/535 |
| 2008/0022593 | A1 * | 1/2008 | Gur et al. | 48/116 |
| 2008/0283411 | A1 | 11/2008 | Eastman et al. | |
| 2009/0082604 | A1 * | 3/2009 | Agrawal | C01B 3/042 585/242 |
| 2010/0258447 | A1 | 10/2010 | Fan | |
| 2011/0062017 | A1 | 3/2011 | Elangovan et al. | |

(Continued)

OTHER PUBLICATIONS

Lee, Dong W., "Internation Search Report", PCT Application No. PCT/US2014/053697 (Corresponding to U.S. Appl. No. 14/474,843), (dated Dec. 5, 2014),1-3.

(Continued)

*Primary Examiner* — Zulmariam Mendez

(74) *Attorney, Agent, or Firm* — Faegre Baker Daniels LLP

(57) ABSTRACT

A method for upgrading bio-mass material is provided. The method involves electrolytic reduction of the material in an electrochemical cell having a ceramic, oxygen-ion conducting membrane, where the membrane includes an electrolyte. One or more oxygenated or partially-oxygenated compounds are reduced by applying an electrical potential to the electrochemical cell. A system for upgrading bio-mass material is also disclosed.

17 Claims, 5 Drawing Sheets

(56) References Cited

U.S. PATENT DOCUMENTS

| | | | |
|---|---|---|---|
| 2011/0315562 | A1 | 12/2011 | Basseyguy et al. |
| 2012/0123168 | A1 | 5/2012 | Bhavaraju |

OTHER PUBLICATIONS

Lee, Dong W., "Written Opinion of the International Searching Authority", PCT Application No. PCT/US2014/053697 (Corresponding to U.S. Appl. No. 14/474,843), (dated Dec. 5, 2014),1-8.
Extended European Search Report issued in EP Application No. 14840946.9, dated Mar. 24, 2017, 4 pages.

* cited by examiner

HYDROGEN UTILIZATION AND CARBON RECOVERY

RELATED APPLICATION

This application claims priority to U.S. Provisional Application Ser. No. 61/872,184, filed Aug. 30, 2013, which is hereby incorporated by this reference.

U.S. GOVERNMENT INTEREST

The Government has rights in this invention pursuant to Contract No. DE-EE0006288 awarded by the U.S. Department of Energy.

FIELD OF THE INVENTION

The present disclosure relates generally to methods and systems for increasing energy density in bio-mass material. More particularly, the present disclosure relates to pyrolysis methods for enriching bio-mass material.

BACKGROUND OF THE INVENTION

Rapid thermal decomposition (pyrolysis) in the absence of oxygen is a process to extract hydrocarbon liquid from woody bio-mass as a potential petroleum substitute. Pyrolysis oil, also known as bio-oil, has properties such as low heating value, incomplete volatility, acidity, instability, and incompatibility with standard petroleum fuels that significantly restrict its application. The undesirable properties of pyrolysis oil result from the chemical composition of bio-oil that mostly consists of different classes of oxygenated organic compounds.

The elimination of oxygen is thus necessary to transform bio-oil into a liquid fuel that would be accepted as transportation fuel and economically attractive. Two types of processes are generally used to remove oxygen from organic molecules: catalytic cracking and hydrotreating.

Catalytic cracking removes oxygen in the form of water and carbon oxides using shape-selective catalysts. Catalytic cracking accomplishes deoxygenation through simultaneous dehydration, decarboxylation, and decarbonylation reactions occurring in the presence of catalysts. In the past, zeolite such as ZSM5 catalysts has been used to perform cracking. Other catalysts such as molecular sieves (SAPOs), mordenite and HY-zeolite have also been utilized. The extent of coking (8-25%), high extent of formation of light ends (gas-phase hydrocarbons) and low quality of final fuel grade products are prohibitive towards a scalable cracking process. All these factors result in carbon and hydrogen loss thereby reducing both carbon and hydrogen efficiencies.

Hydrodeoxygenation ("HDO") is considered the leading technology to achieve oxygen removal from bio-oil. HDO also known as hydrotreating involves high-temperature, high-pressure processing in the presence of hydrogen and catalyst to remove oxygen in the form of water. HDO consists of contacting bio-oil with hydrogen at high pressure and high temperature in presence of a catalyst. Both of these processes require new equipment wherein the capital expenditure is significantly higher. Moreover, the catalyst is susceptible to sulfur and phosphorus impurities in bio-mass. Most of the catalysts used for hydrodeoxygenation are some variations of Co—Mo or Ni—Mo impregnated on a support. Many investigators have focused upon alumina as a preferred catalyst support. Others have investigated carbon, silica and zeolite based supports.

However, HDO suffers from significant challenges, including: 1) coking, which limits the catalyst lifetime; 2) polymerization of various compounds in bio-oil before deoxygenation due to sequential nature of bio-oil productions and catalytic treatment; 3) deactivation of HDO catalysts by the presence of water in the pyrolysis oil (deactivation occurs by leaching sulfur from active sites since these catalysts are usually sulfided prior to HDO process to alleviate coking); 4) hydrothermally unstable nature of zeolite based catalysts compared to noble metal catalysts, which are cost prohibitive; 5) requirement of significant quantities of hydrogen to remove oxygen (cost of hydrogen is approximately $1.50 per gallon of product hydrocarbon); 6) economic availability of hydrogen at distributed smaller scale suitable for bio-mass conversion; and 7) significant process exotherm due to high oxygen removal requirement (25% by mass), which consequentially requires high recycle rates at commercial scale to manage the heat, thereby contributing to high processing costs.

Thus, there are numerous challenges that prevent commercialization of bio-oil upgrading to hydrocarbons process. An alternative economically feasible, hydrogen independent and decentralized process is needed to convert bio-mass derived pyrolysis oil to refinery ready hydrocarbons with an increased energy density.

SUMMARY OF THE INVENTION

Methods and systems for increasing energy density in bio-mass material are disclosed.

In one aspect, a method for upgrading bio-mass material includes providing an electrochemical cell that includes a ceramic, oxygen-permeable membrane. The method also includes providing bio-mass to the electrochemical cell. The bio-mass includes one or more oxygenated or partially-oxygenated compounds. The method also includes passing electrical current through the electrochemical cell.

In another aspect, a method for increasing energy density in bio-mass material includes providing an electrochemical cell including a cathode, an anode, and a ceramic, oxygen-ion conducting membrane. The ceramic, oxygen-ion conducting membrane includes an electrolyte. The method also includes contacting bio-mass with the cathode. The bio-mass includes one or more oxygenated or partially-oxygenated compounds. The method also includes applying an electric potential between the cathode and the anode. The method also includes heating the bio-mass.

In another aspect, a system for upgrading bio-mass material in an electrolytic cell includes a cathode in contact with bio-mass. The bio-mass includes one or more oxygenated or partially-oxygenated compounds. The system also includes an anode. The system also includes a ceramic, oxygen-ion conducting membrane located between the cathode and anode. The system also includes a power source that applies an electric potential between the cathode and anode.

DETAILED DESCRIPTION

Figure 1:
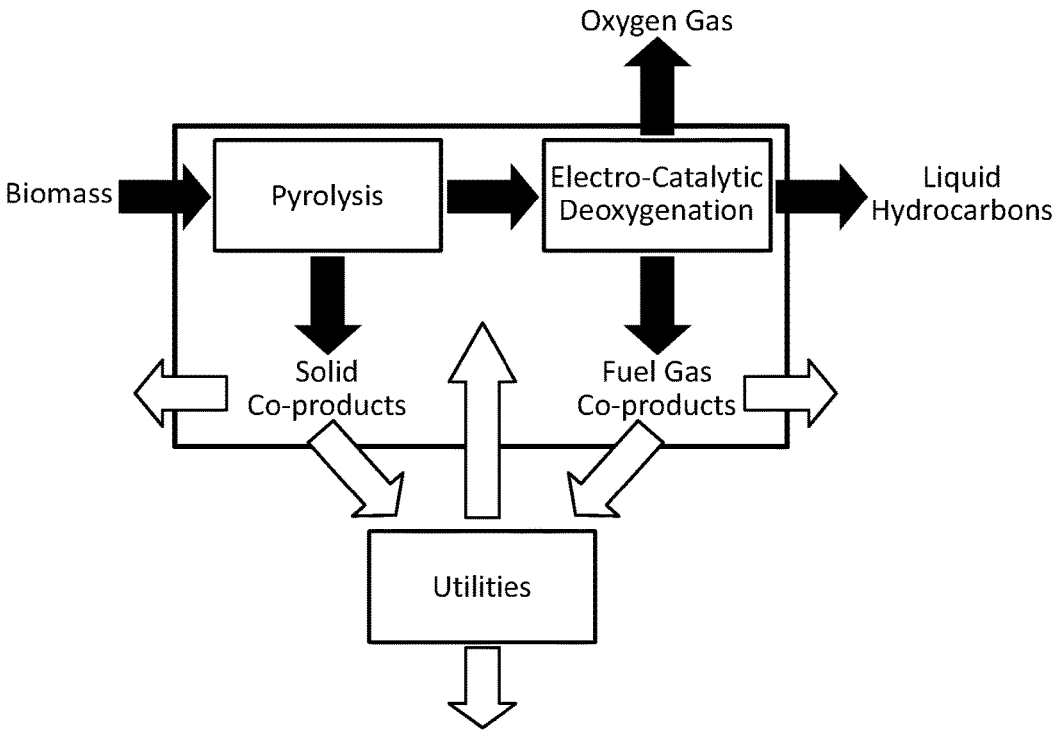
FIG. 1 is a schematic diagram illustrating a means of removing oxygen from bio-mass material, according to one embodiment.

Methods and systems of synergistically converting lignocellulosic bio-mass and electricity to energy dense liquid fuels are disclosed. Because bio-mass materials typically have relatively low energy density, it is hard to transport the materials for fuel needs. Moreover, many of the bio-mass materials include chemical functional groups, like carboxylic acids, which result in gelation, thereby complicating material handling and storage. For example, many of the materials, when stored, turn into gels that can be difficult to process and transport. In addition, electricity is difficult to store for use at sites where bio-mass material is harvested or otherwise collected. This prevents increased utilization of renewable electrical sources such as solar or wind. Furthermore, delivering hydrogen to dispersed bio-mass collection sites is prohibitively expensive.

According to some embodiments, a method is disclosed that increases energy density in bio-mass material, thereby making it easier to transport for fuel needs. In some embodiments, the system may be integrated with renewable electricity sources, thereby amplifying the energy in bio-mass material with renewable energy.

Additionally, in some embodiments, the removal of oxygen from bio-mass material stabilizes the material for transport. According to some embodiments, the system and process produce a product that lacks the acidity problems typical of pyrolysis oil. In some embodiments, the carbon and hydrogen efficiency of the process is considerably higher than the HDO method. The process can be integrated directly with a pyrolyzer. In some embodiments, the overall system operates at atmospheric pressure, thereby obviating the need for expensive pressure vessels.

According to some embodiments, the method for upgrading bio-mass provides an efficient electrochemical deoxygenation ("EDOx") technology with the potential to economically convert oxygenated oils and/or gases to a mixture of hydrocarbon products suitable for subsequent fractionation in conventional refineries. In one embodiment of an EDOx unit, the EDOx process removes oxygen using electrons (provided via electricity) stoichiometrically. In one embodiment, the EDOx process is carried out in an oxygen ion transport dense ceramic membrane reactor that selectively removes oxygen as a gas. Modularity of both the fast pyrolyzer and EDOx unit in some embodiments allows a smaller integrated facility to be economically attractive, thereby increasing both the flexibility for deployment and broadening the potential customer base.

The systems and methods for increasing energy density in bio-mass material provide numerous advantages. For example, the system can be operated substantially free from the need to supply elemental hydrogen. Alternatively, hydrogen can be supplied in reduced amounts compared to conventional techniques. For example, cogeneration facilities using renewable sources and/or existing infrastructure provide electricity or hydrogen gas.

In some embodiments, oxygen gas generated by the electrolysis can be selectively removed as a pure gas. The removal of the oxygen from the pyrolyzed material stabilizes the hydrocarbon product for transport. The EDOx process produces a product with none of the acidity problems typical of pyrolysis oil. In one embodiment, the EDOx process is theoretically 100% carbon and hydrogen efficient because oxygen is removed as $O_2$ (g). If char production is minimized during pyrolysis, the entire system can achieve such atom efficiencies. In one embodiment, the EDOx process is integrated directly with a pyrolyzer. Thus, the overall system can operate at atmospheric pressure, thereby obviating the need for expensive pressure vessels. In one embodiment, modularity of both the fast pyrolyzer and EDOx unit allows a smaller integrated facility to be economically attractive, thereby increasing both the flexibility for deployment and broadening the potential customer base. In one embodiment, oxygen can be recovered as a by-product, which aids in overall process economics. The working principle of the EDOx process is similar to steam electrolysis to produce hydrogen or co-electrolysis of steam and carbon dioxide to produce syngas.

In one aspect, a system for upgrading bio-mass material in an electrolytic cell includes a cathode in contact with bio-mass, an anode, a ceramic, oxygen-ion conducting membrane located between the cathode and anode, and a power source that applies an electric potential between the cathode and anode.

In one embodiment, the bio-mass includes one or more oxygenated or partially-oxygenated compounds. The bio-mass may include bio-oil components including carboxylic acids, ketones, furan derivatives, phenolic compounds, and sugars. The bio-mass may include bio-oil components including one or more of the following: acetic acid, propanoic acid, 2-butenal, 1-hydroxy-2-propane, 1-hydroxy-2-propanone, 3-hydroxy-2-butanone, 1-hydroxy-2-butanone, cyclopentanone, 3-furaldehyde, furfural, 2-cyclopenten-1-one, phenol, 2-cyclopenten-1-one, 2-methyl-2-cyclopentenone, 2-methyl-2-cyclopenten-1-one, o-cresol, 1-hydroxy-2-propanone-acetate, p-cresol, m-cresol, 5-methyl-furfural, 2-hydroxy-3-methyl-2-cyclopenten-1-one, 3-methyl-2-cyclopenten-1-one, 2,4-dimethyl-phenol, o-methoxy-phenol, 2-methoxy-phenol, 2-furanone, 4-ethyl-phenol, 3-ethyl-phenol, 5-methyl-2-furanone, 1,2-benzenediol, 3-methyl-2-furanone, 6-ethyl-o-cresol, 2-methoxy-4-methyl-phenol, 4-methyl-guaiacol, 3-methyl-1,2-benzenediol, 4-methyl-1,2-benzenediol, p-ethyl-guaiacol, 4-methyl-5H-furan-2-one, 4-(2-propenyl)-phenol, 2,5-dimethyl-1,4-benzenediol, 4-ethyl-1,2-benzenediol, 2-methoxy-4-(2-propenyl)-phenol, d-mannose, eugenol, 4-propyl-1,3-benzenediol, 2-methoxy-5-(1-propenyl)-phenol, 2-methoxy-4-propenyl-phenol, vanilin, 4-hydroxy-3-methoxy-benzaldehyde, 4-chromanol, 2-methoxy-4-propyl-phenol, Apocynin, Anhydro-d-mannosan, 1-(4-hydroxy-3-methoxyphenyl)-ethanone, guaiacylacetone, and, 1,2-ethoxy-6-(methoxy methyl)-phenol, and mixtures of the same.

In one embodiment, the anode is an air electrode. In one embodiment, the anode is a lanthanum-strontium-manganite ("LSM") electrode. In one embodiment, the anode is an oxygen electrode. Suitable oxygen electrodes include electronic conducting ceramic materials such as doped lanthanum manganite, lanthanum cobaltite, or oxygen ion-electron mixed conducting ceramic materials such as doped lanthanum cobalt ferrite, or other suitable ceramics belonging to the family of perovskites, pyrochlore and others. The anode may include one or more of the following: doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, nickel-doped zirconia, nickel-doped ceria, nickel, cobalt, molybdenum, ruthenium, platinum, praseodymium, cerium, other elements from the rare earth element group or from the precious metal group, or combinations thereof.

In one embodiment, the anode is a doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, or combinations thereof. In one embodiment, the anode is cobalt-ferrite perovskite.

In one embodiment, the cathode is sulfur tolerant based on a modified Ni-ceria composite. In one embodiment, the cathode is sulfur tolerant up to about 100 s of ppm $H_2S$ and is coke resistant to gaseous hydrocarbons. The cathode may include Cu or Cu—Ni as a coating material on the metal interconnect. The coating material can provide additional coke and sulfur tolerance in the presence of higher hydrocarbons and oxygenates that may be present in the bio-oil.

In one embodiment, the cathode is a fuel (bio-oil) side electrode. Fuel (bio-oil) side electrodes could be a mixture of ceramics and metal (cermet). Examples include nickel-doped zirconia, nickel-doped ceria. The metal can be a mixture (for example an alloy) of metals such as nickel-copper or a substantially pure metal such as copper. The fuel side electrode may also contain catalyst particles such as Ni, Co, Mo, Ru, Pt, Pr, Re, or Ce or any catalyst particles from the rare earth element group or precious metal group. The fuel side electrode can include a combination of catalyst particles to provide catalytic functions. Examples of combinations include Co—Mo, Ni—Mo, Ni—W and other combinations to provide catalytic functions. In another embodiment the catalyst particles may be sulfided, carbided or phosphided. Examples include MoS, $Mo_2C$, MoP, $Ni_2P$, WP, and CoP. In another embodiment, the fuel-side electrode is only made of ceramic. Examples of ceramic fuel-side electrode include strontium titanate, doped ceria, doped lanthanum chromite and the like. In one embodiment, the fuel-side electrode is based at least partially on the composition of bio-mass material and the tendency to coke. Some electrodes, for example all ceramic or Cu containing ones, show less tendency to coke.

The cathode may include one or more of the following: doped lanthanum manganite, doped lanthanum cobaltite, doped lanthanum cobalt ferrite, oxygen ion-electron conducting ceramics belonging to the family of perovskites or pyrchlores, nickel-doped zirconia, nickel-doped ceria, nickel, cobalt, molybdenum, ruthenium, platinum, praseodymium, cerium, other elements from the rare earth element group or from the precious metal group, or combinations thereof. In one embodiment, the cathode includes nickel-doped zirconia, nickel-doped ceria, nickel, cobalt, molybdenum, ruthenium, platinum, praseodymium, cerium, other elements from the rare earth element group or from the precious metal group, or combinations thereof. In one embodiment, the cathode includes nickel-ceria.

In one embodiment, the system also includes an electrolyte or an electrolytic layer. In one embodiment, the electrolyte or electrolytic layer is located between the cathode and anode. In one embodiment, the system uses any high temperature oxygen ion conducting electrolyte. In one embodiment, the electrolyte or electrolytic layer is at least partially made of zirconia doped with trivalent cations. The trivalent cations may include yttria, scandia, ytterbia. In one embodiment, the electrolyte or electrolytic layer is zirconia doped with yttria, scandia, ytterbia, and the like or combinations thereof. In one embodiment, the electrolyte or electrolytic layer includes scandium-doped zirconia. In one embodiment, the electrolyte or electrolytic layer includes ceria doped with trivalent cations. The trivalent cations may include yttria, samaria, gadolinia. In one embodiment, the electrolyte or electrolytic layer is strontium and magnesium doped lanthanum gallate.

In one embodiment, the system includes a means for heating the electrolytic cell to a temperature between about 400° C. to about 1000° C. In another embodiment, the system includes a means for heating the electrolytic cell to a temperature between about 500° C. to about 800° C. The system may include a heater such as a natural gas burner. In one embodiment, the system is heated with the hydrocarbon gases separated from the hydrocarbon vapors following the EDOx process. The char produced in the pyrolysis process may be combusted to provide the heat for the system. The sensible heat of the bio-oil vapor may be used to heat the EDOx unit.

In one embodiment, the system can economically convert oxygenated oils and/or vapors to a mixture of hydrocarbon products suitable for subsequent fractionation in conventional refineries.

FIG. 1 shows a schematic system for increasing energy density in bio-mass material, according to one embodiment. As depicted, bio-mass undergoes pyrolysis. The solid co-products may then be used in utility applications. The non-solid co-products may then undergo electro-catalytic deoxygenation. In some embodiments, electro-catalytic deoxygenation produces one or more of the following by-products: oxygen gas, liquid hydrocarbons, and fuel gas co-products. The fuel gas co-products may be used in utility applications.

In some embodiments, the bio-mass oil can be cooled to separate the aqueous and non-aqueous phases and separately heated to EDOx suitable temperature to deoxygenate the compounds. In one embodiment, deoxygenation is performed without cooling.

In another aspect, a method for upgrading bio-mass material is disclosed. The method includes the step of providing an electrochemical cell that has a ceramic, oxygen-ion conducting membrane. The membrane is sandwiched between two electrodes, an anode and a cathode. Optionally, the method for upgrading bio-mass may utilize aspects of the electrodes of the types described in U.S. Pat. No. 8,354,011 and U.S. Pat. No. 7,976,686, both patents hereby incorporated by reference in their entireties.

Bio-mass is then provided to that electrochemical cell. The bio-mass includes one or more oxygenated or partially-oxygenated compounds. An electrical potential or current is then applied to the cell. The degree of upgrading of the bio-mass material may be modulated by the amount of electric potential applied through the electrochemical cell. In one embodiment, the method also includes the step of heating the bio-mass. In one embodiment, the method also includes the step of removing oxygen gas from the cell.

The electric current can from a variety of sources. In one embodiment, the electricity and/or electric current is obtained from cogeneration facilities and/or existing infrastructure. Similar to steam electrolysis, the method can be nearly 100% efficient electrically, i.e., nearly all electrical energy is captured in the heating value of deoxygenated bio-oil and gaseous hydrocarbon.

In one embodiment, the electrochemical cell is operated substantially free of hydrogen gas. In one embodiment, the electrochemical cell excludes the use of an external hydrogen source. In one embodiment, the electrochemical cell is operated free of any hydrogen gas.

In one embodiment, the bio-mass is heated to a temperature between about 400° C. to about 1000° C. The bio-mass may be heated to a temperature between about 500° C. to about 800° C. In another embodiment, the bio-mass is heated to a temperature of about 400° C. The bio-mass may be heated to a temperature of about 500° C. In one embodiment, the bio-mass is heated to a temperature of about 600° C. The bio-mass may be heated to a temperature of about 700° C. In one embodiment, the bio-mass is heated to a temperature of about 800° C. In another embodiment, the bio-mass is heated to a temperature of about 900° C. The bio-mass may be heated to a temperature of about 1000° C.

In another aspect, a method for increasing energy density in bio-mass material is disclosed. The method includes the step of providing an electrochemical cell. In one embodiment, the electrochemical cell includes a ceramic, oxygen-ion conducting membrane, a cathode, and an anode. In one embodiment, only oxygen ions pass through the membrane. In one embodiment, the method also includes the step of contacting bio-mass with the cathode. In one embodiment, the bio-mass includes one or more oxygenated or partially-oxygenated compounds. In one embodiment, the method also includes the step of applying an electric potential between the cathode and the anode.

In one embodiment, the method also includes the step of heating the bio-mass. In one embodiment, the bio-mass is heated to a temperature that reduces the degree of oxygenation of the bio-mass.

In one embodiment, multiple electrochemical cells each including cathode, electrolyte, and anode are separated by an interconnect material. In one embodiment, each cell is separated by an interconnect material made of metal or ceramic or combinations thereof. Examples of interconnect material include stainless steel, super alloys, electrically conducting ceramic oxides such as doped lanthanum chromite.

In one embodiment, the electrolyte is located between the anode and the cathode. In one embodiment, the electrolyte includes zirconia doped with one or more trivalent cations selected from the group consisting of: yttria, scandia, ytterbia, and combinations thereof. In one embodiment, the electrolyte includes ceria doped with one or more trivalent cations selected from the group consisting of: yttria, ytterbia, samaria, gadolinia, and combinations thereof. In one embodiment, the electrolyte includes lanthanum gallate doped with strontia and magnesia.

In one embodiment, the bio-mass is heated to a temperature that activates the bio-mass. The electricity may then split the bio-mass to produce oxygen ions and hydrocarbon ions. In one embodiment, the oxygen ions from bio-mass splitting is transported across the ionic membrane. According to some embodiments, the method also includes the step of heating water at the cathode to a temperature that vaporizes the water. In some embodiments, the method also includes the step of generating steam that contacts the cathode thereby ionizing the steam and producing reactive hydrogen. The ionization of the steam produces reactive hydrogen. The electricity splits water at high temperature. The oxygen from the water splitting is transported across the ionic membrane.

In one embodiment, the reactive hydrogen from the water splitting deoxygenates the oxygenated compounds of the bio-mass material. In one embodiment, the reactive hydrogen reacts with hydrocarbon ions in the electrochemical cell to form one or more hydrocarbon compounds. In one embodiment, the bio-mass and water are heated simultaneously. In another embodiment, the bio-mass and water are heated at different times. In one embodiment, one hydrocarbon ion can combine with other similar ions or fragments to form one or more dimers or other complex hydrocarbons that have potentially reduced oxygen content. The type of hydrocarbon formed depends on one or more of the following: the catalytic properties of the cathode, the type of oxygenated compound, and cell temperature.

In one embodiment, about 20% to about 40% of oxygen is recovered as a by-product from the bio-mass material. In another embodiment, more than 20% of oxygen is recovered as a by-product from the bio-mass material. In one embodiment, about 30% of oxygen is recovered as a by-product from the bio-mass material. In another embodiment, about 40% of oxygen is recovered as a by-product from the bio-mass material.

In one embodiment, the number of oxygen atoms in the bio-mass material is reduced by one or more oxygen atoms following the step of heating the bio-mass and applying electric potential to the electrochemical cell. In one embodiment, there are no oxygen atoms remaining in the bio-mass material following the step of heating the bio-mass and applying electric potential to the electrochemical cell. In one embodiment, the number of oxygen atoms of one or more bio-mass components is reduced by one or more oxygen atoms following the step of heating the bio-mass material and applying electric potential to the electrochemical cell. In one embodiment, there are no oxygen atoms remaining in one or more bio-mass components following the step of heating the bio-mass material and applying electric potential to the electrochemical cell.

Figure 2:
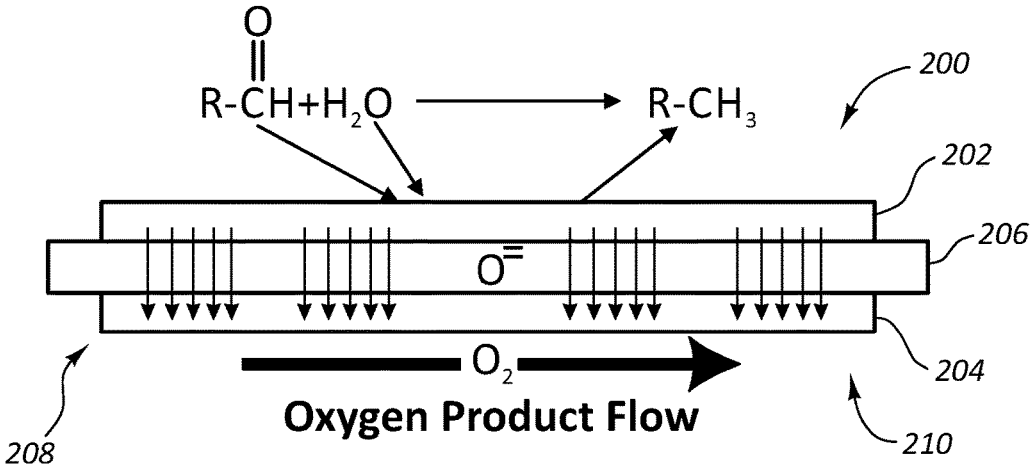
FIG. 2 is a cross-sectional view of an electrochemical cell illustrating the removal of oxygen from bio-mass material, according to one embodiment.

FIG. 2 is a cross-sectional view of an electrochemical cell illustrating the removal of oxygen from bio-mass material, according to one embodiment. As shown in FIG. 2, electrochemical cell 200 includes cathode 202, anode 204, and electrolyte 206. In the embodiment of FIG. 2, electrolyte 204 is located between cathode 202 and anode 206. FIG. 2 shows the direct deoxygenation of an oxygenated compound on the surface of cathode 202. The oxygen ions removed at the surface of cathode 202 are transported from cathode 202, across electrolyte 206, and to anode 204. The oxygen leaves electrochemical cell 200 in the form of oxygen gas. Electrochemical cell 200 of FIG. 2 includes front end 208 and back end 210. In one embodiment, the oxygen gas that is released from electrochemical cell flows in a direction from front end 208 to back end 210. As shown in FIG. 2, in some embodiments, the process removes all oxygen atoms from the oxygenated compound. In other embodiments, the process partially removes the number of oxygen atoms.

In one embodiment, the method includes the step of removing oxygen from bio-mass material using stoichiometric electrons (provided via electricity). In one embodiment, the method is carried out in an oxygen ion transporting dense ceramic membrane reactor that selectively removes oxygen as a pure gas. In one embodiment, the membrane only removes oxygen as a gas. In one embodiment, the membrane only removes oxygen as a pure gas.

In one embodiment, the oxygen from the oxygenated or partially-oxygenated compound may be directly removed through the electrochemical process or indirectly by reaction with the hydrogen produced from electrolyzing (i.e., removing oxygen from) steam that is present. This is similar to the co-electrolysis (simultaneous electrolysis of $CO_2$ and $H_2O$) process. Optionally, the method for upgrading bio-mass may utilize aspects of the electrolysis processes and systems described in U.S. Pat. No. 8,075,746 and U.S. Pat. No. 7,951,283, both patents hereby incorporated by reference in their entireties.

In one embodiment, high temperature electrolysis using solid oxide electrolyte cells is used to generate high purity hydrogen. Co-electrolysis is fundamentally a variation of high temperature steam electrolysis. In one embodiment, an electrical potential is applied across a gas tight and electrically insulating ceramic membrane, having a high conductivity of oxygen ions.

Zirconia ($ZrO_2$), doped with tri-valent cations (e.g., $Y_2O_3$ to 8 mole %) may be used to stabilize a cubic structure and introduce oxygen vacancy defects. If the potential is greater than the free energy of formation, corrected for local reactant and product partial pressures, an $H_2O$ or $CO_2$ molecule will decompose as one oxygen atom is transported across the membrane in the form an oxygen ion ($O^{=}$) leaving behind hydrogen or carbon monoxide. However, quantitative analysis of co-electrolysis is significantly more complex than simple steam electrolysis. This is primarily due to the multiple, interacting reactions that occur: steam electrolysis, $CO_2$ electrolysis, and the reverse shift reaction (RSR), as shown in Formula 1:

$$CO_2+H_2 \leftrightarrow CO+H_2O. \qquad \text{Formula 1}$$

Reaction kinetics govern the relative contributions of these three reactions. It is also important to note that the electrolysis reactions are not equilibrium reactions. In some embodiments, the electrolyte separates the products from the reactants. However, the RSR is a kinetically fast, near equilibrium reaction at high temperature in the presence of a Ni catalyst. In one embodiment, the electrolysis cell cathode includes a nickel ceramic composite and an effective shift or reforming catalyst. In one embodiment, all four species participating in the RSR are present on the cathode, as shown in FIG. 3.

A similar process scheme can be envisioned for deoxygenation of bio-mass oil vapor. Similar to electrolysis of $CO_2$, oxygen can be extracted directly from an oxygenated compound by application of electric potential across a solid oxide cell, or from steam ($H_2O$ molecule), which in turn produces hydrogen.

Figure 3:
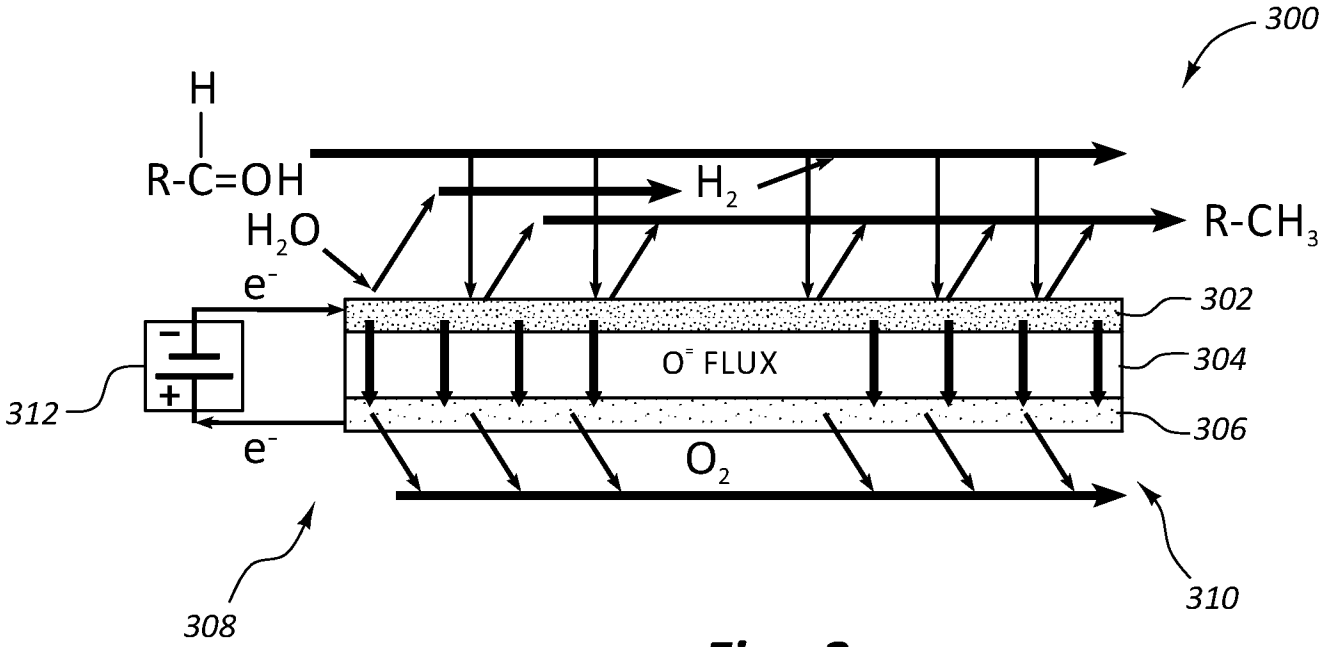
FIG. 3 is a cross-sectional view of an electrochemical cell utilizing an electric potential to remove oxygen from bio-mass material, according to one embodiment.

FIG. 3 is a cross-sectional view of an electrochemical cell utilizing electricity to remove oxygen from bio-mass material, according to one embodiment. As shown in FIG. 3, electrochemical cell 300 includes cathode 302, anode 306, and electrolyte 304. In the embodiment of FIG. 3, electrolyte 304 is located between cathode 302 and anode 306. FIG. 3 shows the direct deoxygenation of an oxygenated compound on the surface of cathode 302 when power source 312 provides an electric potential between cathode 302 and anode 306. In one embodiment, the oxygen ions removed at the surface of cathode 302 are transported from cathode 302, across electrolyte 304, and to anode 306. The oxygen leaves electrochemical cell 300 in the form of oxygen gas. Electrochemical cell 300 of FIG. 3 includes front end 308 and back end 310. In one embodiment, the oxygen gas that is released from electrochemical cell flows in a direction from front end 308 to back end 310. In one embodiment, the oxygen gas is collected as a by-product.

In FIG. 3, the application of electric potential results in the ionization of steam at cathode 301, thereby producing oxygen ions and hydrogen. The oxygen from the water splitting is transported across the membrane of electrochemical cell 300. The hydrogen from the water splitting deoxygenates the oxygenated compounds of the bio-mass material. The hydrogen reacts with the hydrocarbon ions to form one or more hydrocarbon compounds. The hydrogen produced from the water splitting reacts with oxygenated compounds to produce lower oxygenates or even hydrocarbons and water.

In one embodiment, the extent of reduction is determined by one or more of the following: the hydrogen partial pressure, temperature, and electric current generated by the applied voltage. Table 1 shows the kinds of reactions that can happen in the cathode chamber by hydrogen reduction of pyrolysis vapor resulting in hydrocarbons.

A typical and analogous reactions of bio-oil components are shown in Table 1. Other equivalent reactions may also occur in other embodiments. In all reactions, as stated above, $H_2$ may be provided from electrolysis of steam present in the bio-oil or direct electrochemical ionization of oxygen and transport of oxygen ion through the membrane.

TABLE 1

Hydrocarbons from Pyrolysis Oil

| | | | |
|---|---|---|---|
| Acids | R—COOH + $3H_2$ | → | $RCH_3 + 2H_2O$ |
| Acids | 2R—COOH | → | R—R + $2CO_2$ |
| Aldehydes | R—CHO + $2H_2$ | → | R—$CH_3$ + $H_2O$ |
| Aldehydes | 2R—CHO + $3H_2$ | → | R—$CH_2$—$CH_2$—R + $2H_2O$ |
| Ketones | R—CO—R + $2H_2$ | → | $R_2CH_2 + H_2O$ |
| Ketones | 2R—CO—R' + $3H_2$ | → | RR'CH—CHR'R + $2H_2O$ |
| Alcohols | R—$CH_2OH$ + $H_2$ | → | R—$CH_3$ + $H_2O$ |
| Ethers | 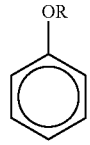 | | 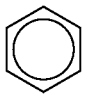 + ROH |
| Phenols | 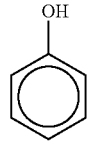 | | 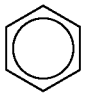 + $H_2O$ |

Figure 4:
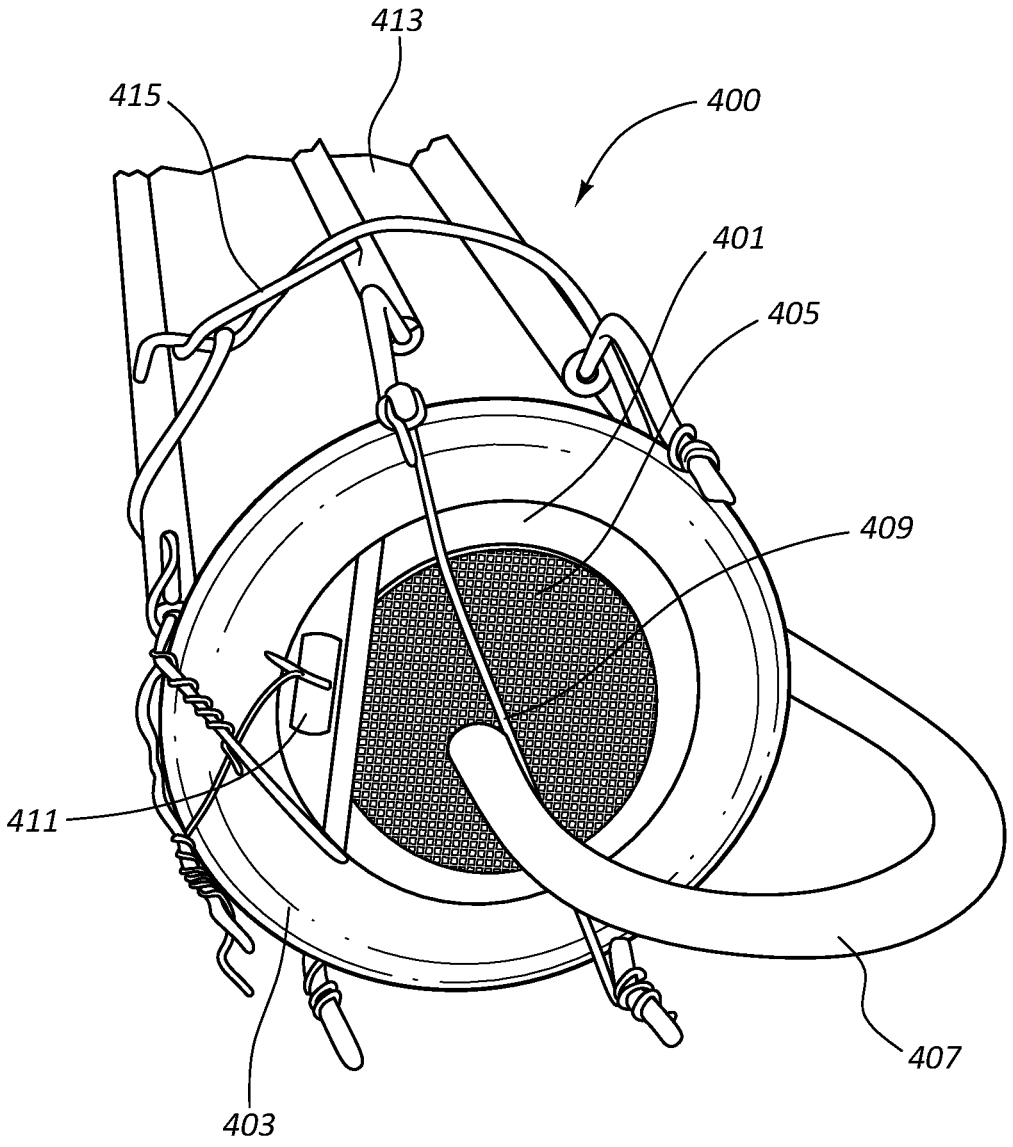
FIG. 4 is a perspective view of an electrochemical cell for removing oxygen from bio-mass material, according to one embodiment.

FIG. 4 shows electrochemical button cell 400, according to one embodiment. Electrochemical button cell 400 is a solid oxide electrolysis button cell with about 2 $cm^2$ electrode area is used, at about 650° C. The temperature of electrochemical button cell 400 is measured with thermocouple 407.

Electrochemical button cell 400 consists of Sc-doped zirconia electrolyte 403, cobalt-ferrite perovskite anode 401, and nickel-ceria composite cathode (not shown). The ceria-composite cathode is located on the interior side of alumina tube 413. Electrochemical button cell 400 also includes reference electrode 411.

In one embodiment, acetone is used as the oxygenated hydrocarbon. Protons or hydrogen generated from steam electrolysis can be used to hydrodeoxygenate acetone to yield similar products. In one embodiment, the process may include a combination of both.

In one embodiment, acetone vapor, steam, and hydrogen are provided to electrochemical button cell 400 through alumina tube 413. According to the embodiment of FIG. 4, electrochemical button cell 400 is manifolded on the cathode side so that vapors of the bio-mass can be fed to the cathode through alumina tube 413. In FIG. 4, anode 401 where oxygen, transported from the oxygenated bio-oil compound and steam in the feed, is evolved is open to ambient air. In one embodiment, oxygen is collected as a by-product.

According to FIG. 4, electrochemical button cell 400 also includes platinum mesh current distributor 405 that is attached to the cathode. In another embodiment, the electrochemical button cell includes a current collector attached to the cathode. In one embodiment, a platinum mesh current collector or a nickel mesh current collector is attached to the cathode. In FIG. 4, platinum mesh current distributor 405 is attached to power lead wire 409. Multiple leads may be attached to each of the platinum mesh and some may be used to measure cell voltage and others to measure current through the cell. Support structure 415 may be used to secure one or more power lead wire 409. In FIG. 4, support structure 415 consists of flexible wire that holds power lead wire 409 in place.

In one embodiment, the system and process may convert an acetone and water mixture to propane using electricity. The electricity splits water at high temperature wherein the produced hydrogen removes the oxygen. The oxygen from water splitting is transported across the ionic membrane.

Due to varying vapor pressures of acetone and water, two separate feed systems may be used: a water bath at about 82° C. through which hydrogen gas is bubbled, and an acetone bath at about ambient temperature through which nitrogen gas is bubbled. In one embodiment, the two streams are mixed and fed into the cathode chamber using alumina tube 407.

As the nickel in the cathode of FIG. 4 is likely to be a chemical catalyst, the outlet gas composition is measured both at no current (open circuit voltage, OCV) and under a current of about 100 mA. Analysis can be done using two separate gas chromatographs (HP 7890 and Agilent microGC) so that concentrations of permanent gases and hydrocarbons can be measured. In one embodiment, there are some overlapping species such as methane, ethane and ethylene. In one embodiment, at OCV, the outlet gas contains largely methane (greater than about 80%) with less than about 1% of ethane and ethylene. This demonstrates the formation of a hydrocarbon from an oxygenated species.

In one embodiment, the use of only nickel for the cathode produces a large amount of methane. In one embodiment, a cobalt composite cathode may be used to form propane. In some embodiments, other catalytic materials may be used for the cathode. In one embodiment, cobalt, molybdenum and rhenium are deposited on the surface of the cathode to enable in-situ electro-deoxygenation and to prevent cracking of hydrocarbon which may produce coke. In one embodiment, the product distribution depends on one or more of the following: operating temperature, initial concentration of bio-mass material, applied voltage, electric current, and the composition of cathode.

In one embodiment, the feed rate of bio-mass vapors into the electrochemical cell is approximately 1.67 g/hr (approximately $2.24\times10^{-4}$ mole/min). In another embodiment, guaiacol is fed into an electrochemical cell at approximately 1.67 g/hr. In one embodiment, the feed rate for $H_2$ is approximately 10 sccm (approximately $4.46\times10^{-4}$ mole/min or approximately 0.013452554 moles/hr). In another embodiment, the feed rate of steam is approximately 6.6 sccm (approximately $2.95\times10^{-4}$). In one embodiment, the feed rate for $N_2$ is approximately 30 sccm. In one embodiment, $H_2$ is not fed into an electrochemical cell, because it will be generated by steam electrolysis. In one embodiment, oxygen is available from guaiacol at a rate of approximately $2.24\times10^{-4}$ mole/min. In one embodiment, oxygen is available from steam at a rate of approximately $1.48\times10^{-4}$ mole/min.

In one embodiment, the temperature of the electrochemical cell is in a range between approximately 500° C. and approximately 600° C. Alternatively, the temperature of the electrochemical cell may be approximately 550° C. In another embodiment, the temperature of the electrochemical cell is approximately 500° C. In one embodiment, the temperature of the electrochemical cell is approximately 600° C.

Figure 5:
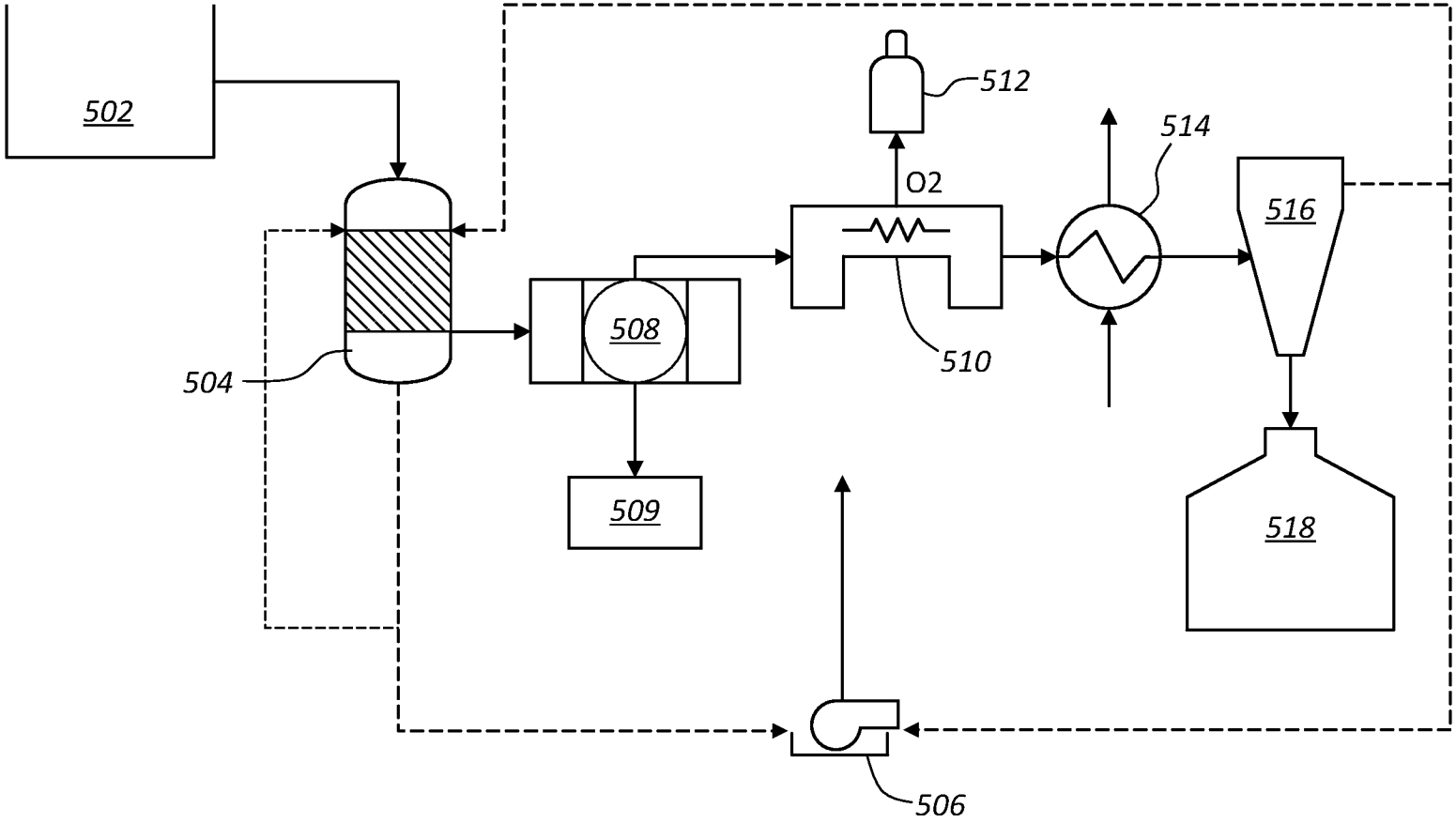
FIG. 5 is a schematic diagram illustrating the incorporation of the system in a hydrocarbon production facility, according to one embodiment.

FIG. 5 provides a conceptual process design for approximately 20 gallons per day of hydrocarbon production facility that would be hydrogen independent. Upon scale-up, such an integrated plant would lead to economical production of hydrocarbons. According to the embodiment of FIG. 5, bio-mass is contained in bio-mass container 502. The bio-mass material may then be transported from bio-mass container 502 to pyrolyzer 504, where pyrolysis of the bio-mass may occur. Pyrolyzer 504 vaporizes the bio-mass to produce bio-mass vapors. The bio-mass vapors may then be passed through gas cleaner 508 to remove any contaminants before being injected into EDOx unit 510. EDOx unit 510 is optimized to operate at the exit temperature of pyrolyzer 504 such that gas equilibrium is maintained, thereby minimizing the driving force for coking.

In one embodiment, EDOx unit 510 can be a stack of planar cells. In one embodiment, the stack of planar cells includes an anode layer, an electrolyte layer, and a cathode layer. In one embodiment, each planar cell is separated by an interconnect material made of metal or ceramic or combinations thereof. In one embodiment, the interconnect material is coated with an appropriate material to prevent promotion of coking of the bio-oil vapors. In one embodiment, EDOx unit 510 can be built using tubular cells or other shapes to improve physical and process integration with the pyrolyzer.

In one embodiment, oxygen gas is released from EDOx unit 510 and collected into oxygen vessel 512. Following pyrolysis in pyrolyzer 504, the remaining char may provide cogeneration for utilities at cogeneration site 506. The ash may be removed prior to providing cogeneration for utilities. Hydrocarbon vapors are released from EDOx unit 510. At this point, the hydrocarbon vapors contain fewer oxygen atoms than prior to entering EDOx unit 510, according to some embodiments. The hydrocarbon vapors are collected from the EDOx unit 510 and passed through condenser 514 to condense the hydrocarbon vapors into a mixture of hydrocarbon gases and liquids. The mixture of hydrocarbon gases and liquids may then pass through gas/liquid separator 516. The hydrocarbon liquids may then be collected in vessel 518. In one embodiment, the hydrocarbon gases that exit gas/liquid separator 516 may be used to provide heat to pyrolyzer 504. In another embodiment, the hydrocarbon gases may provide cogeneration for utilities at cogeneration site 506.

Besides containing oxygenated compounds, bio-mass oil contains a combination of water soluble, organic soluble compounds. When cooled, they phase separate and also become unstable, i.e., they polymerize and become difficult to process to make useful fuels. In one embodiment, the process converts water-soluble oxygenates into water insoluble hydrocarbons. In one embodiment, the process allows direct transfer of pyrolysis vapors (from pyrolyzer 504) to EDOx unit 510 without cooling the vapors. In one embodiment, EDOx unit 510 operates efficiently over a range of temperature between about 600° C. to about 1000° C. In one embodiment, EDOx unit 510 operates efficiently over a range of temperature between about 500° C. to about 800° C. In one embodiment, EDOx unit 510 operates at a temperature as low as about 400° C. with the use of lower temperature electrolyte system.

In one embodiment, the pyrolysis vapor can also be slightly heated from the typical pyrolyzer temperature of about 500° C. to match the operating temperature of EDOx unit 510. In another embodiment, the pyrolysis vapor can also be slightly heated from the typical pyrolyzer temperature of about 550° C. to match the operating temperature of EDOx unit 510. In one embodiment, the pyrolysis vapor can also be slightly heated from the typical pyrolyzer temperature of about 600° C. to match the operating temperature of EDOx unit 510.

According to the embodiments, more than about 95% carbon and hydrogen efficiency is attainable in the proposed process. This is possible because oxygen is removed in its elemental form, and not as a molecule combined with carbon or hydrogen. In some embodiments, energy is required to produce $O_2$ (g), and this energy is supplied by electricity, which is stored in an energy dense liquid hydrocarbon fuel where the hydrogen and carbon come from cellulosic biomass. In one embodiment, this process is based on high temperature electrolysis process. The high temperature electrolysis process is endothermic, while the resistive loss (i.e. electrical resistance of the membrane and electrodes) is exothermic. An approximately 100% efficiency of electricity to heating value of product may be achieved by carefully selecting the process operating voltage so that the endotherm and exotherm match. The voltage, commonly termed thermal neutral voltage $V_{tn}$ is calculated as: $V_{tn}=(\Delta H)/(nF)$, where $\Delta H$ is the enthalpy of reaction, n is the number of electrons involved, and F is Faraday's constant.

In one embodiment, the process has a demonstrated efficiency of greater than about 96% for both steam electrolysis to make hydrogen, and $CO_2$ and steam co-electrolysis to make syngas in an about 4 kW laboratory module. In one embodiment, the $\Delta H$ value depends on the relative amounts of various molecules. In one embodiment, the overall electrical efficiency is expected to be about 90% or greater. In one embodiment, the net positive impact on efficiency is a range between about 16% and about 28% per unit of upgraded hydrocarbons.

The life cycle GHG intensity of the process saves about 20% of the energy required to upgrade pyrolysis oil relative to the process of hydrotreating. In one embodiment, the process leads to a GHG intensity in a range of approximately 28 $CO_2$e/MJ to approximately 30 $CO_2$e/MJ of hydrocarbon produced, relative to approximately 39 $CO_2$e/MJ of hydrotreating as estimated using the GREET model and literature data. Thus, according to some embodiments, the process results in a GHG intensity reduction in a range of approximately 25% to approximately 30%. In embodiments where renewable electricity is used for conversion of the bio-mass material, the process may result in a GHG intensity reduction in a range of approximately 60% to approximately 70%.

EXAMPLES

Other uses, embodiments and advantages of the systems and methods for upgrading bio-mass material in an electrolytic cell are further illustrated by the following examples, but the particular materials and amounts cited in these examples, as well as other conditions and details, should not be construed to unduly limit the systems and methods for upgrading bio-mass material in an electrolytic cell.

Example 1

In one example, the electrochemical cell was an (yttria-stabilized zirconia) YSZ electrolyte based cell. The cathode was nickel-ceria cermet and the anode was lanthanum ferrite-cobaltite type perovskite. It was tested at about 700° C. using acetic acid with $N_2$ as the carrier gas and steam with $N_2$ as the carrier gas. The two streams were fed from separate heated containers and the resulting vapors were mixed prior to entry into the fuel manifold of the cell. This was tested at three different current densities as well as at the open circuit condition (OCV). Hydrogen was added to the steam in the OCV condition to prevent oxidation of the fuel electrode. The exhaust product gas was analyzed using a micro-GC for each condition. This cell was also tested on acetone with $N_2$ as the carrier gas and with steam and $N_2$ at both approximately 700° C. and approximately 800° C. test temperatures. Three different current densities were tested at each temperature and GC samples were analyzed for each. The gas composition results from the GC sampling for each test condition are given below in Table 2.

TABLE 2

Product gas analysis from electrochemical cell on acetic acid and acetone.

| Temp | Organic | Voltage | Current | H2 | CH4 | CO | CO2 | Ethene | Ethane | Propane | Butane |
|---|---|---|---|---|---|---|---|---|---|---|---|
| 700 | Acetic Acid | 1.300 | 0.113 | 39.4% | 1.8% | 34.0% | 5.9% | | | 18.3% | |
| 700 | Acetic Acid | 1.115 | 0.082 | 36.9% | 1.4% | 39.1% | 5.7% | | | 16.2% | |
| 700 | Acetic Acid | 0.973 | 0.050 | 35.5% | 1.5% | 40.1% | 5.8% | | | 16.4% | |
| 700 | Acetic Add | 0.828 | 0.000 | 65.9% | 1.2% | 22.2% | 2.9% | | | 7.6% | |
| 700 | Acetone | 1.300 | 0.046 | 79.5% | 3.0% | 7.1% | 0.4% | 0.2% | 0.2% | 0.7% | 9.0% |
| 700 | Acetone | 1.450 | 0.080 | 70.6% | 9.0% | 6.0% | 0.8% | 0.2% | 0.2% | 0.7% | 12.4% |
| 700 | Acetone | 1.600 | 0.116 | 70.1% | 9.1% | 6.1% | 0.8% | 0.2% | 0.2% | 0.8% | 12.8% |
| 800 | Acetone | 1.300 | 0.175 | 48.4% | 27.4% | 19.3% | 0.9% | 0.6% | 0.6% | 0.9% | 0.7% |
| 800 | Acetone | 1.450 | 0.244 | 46.5% | 28.8% | 19.7% | 0.6% | 0.7% | 0.7% | 0.8% | 0.8% |
| 800 | Acetone | 1.600 | 0.331 | 43.1% | 30.9% | 20.9% | 0.7% | 1.0% | 1.0% | 1.0% | |

From Table 1, it can be seen that $H_2$ production is high from the electrolyzed steam and that it is more favored using acetone over acetic acid. Also, using acetone at approximately 800° C. produces more $CH_4$ and CO with less butane than is produced using acetone at approximately 700° C.

Example 2

In order to reduce the cell's operational temperature to one that is more in line with the bio-oil reactor, lower temperature cells made from doped ceria electrolyte were tested. In this example, the cathode was nickel-ceria cermet and the anode was Sr doped lanthanum cobaltite. The electrochemical cell was tested at approximately 600° C., approximately 550° C., and approximately 800° C. using acetone with $N_2$ as the carrier gas and steam with $N_2$ gas. Hydrogen gas was only flowing with the steam during OCV condition to prevent oxidation of the electrode. This cell was also operated on furfural at approximately 550° C. with $N_2$ as carrier gas and steam with $N_2$ as the carrier gas. Several current densities were evaluated for each of the temperature and organic combinations and a list of their product compositions is below in Table 3.

TABLE 3

Product gas analysis from electrochemical cell on acetone and furfural.

| Temp | Organic | Voltage | Current | H2 | CH4 | CO | CO2 | Ethene | Ethane | Propane | Butane | Pentane |
|---|---|---|---|---|---|---|---|---|---|---|---|---|
| 600 | Acetone | 1.15 | 0.25 | 92.8% | 0.5% | 2.6% | 1.8% | | | 2.2% | | |
| 600 | Acetone | 1.30 | 0.50 | 95.0% | 0.5% | 2.4% | 0.6% | | | 1.6% | | |
| 600 | Acetone | 1.45 | 0.86 | 93.7% | 0.5% | 2.7% | 1.1% | | | 2.0% | | |
| 550 | Acetone | 1.15 | 0.13 | 91.6% | 1.0% | 2.8% | 2.0% | | | 2.6% | | |
| 550 | Acetone | 0.87 | 0.00 | 89.9% | 1.7% | 4.9% | 1.6% | | | 1.8% | | |
| 550 | Acetone | 1.15 | 0.12 | 92.1% | 1.2% | 2.8% | 2.1% | | | 1.9% | | |
| 550 | Acetone | 1.30 | 0.34 | 92.2% | 1.1% | 2.4% | 2.4% | | | 2.0% | | |
| 550 | Acetone | 1.45 | 0.45 | 93.4% | 1.0% | 1.6% | 2.0% | | | 2.1% | | |
| 800 | Acetone | 0.69 | 0.00 | 51.3% | 22.2% | 21.6% | 1.8% | 1.0% | 0.7% | 1.5% | | |
| 800 | Acetone | 1.00 | 0.16 | 50.0% | 23.2% | 20.2% | 3.2% | 1.1% | 0.8% | 1.4% | | |
| 800 | Acetone | 1.30 | 0.40 | 49.5% | 23.7% | 20.3% | 3.2% | 1.1% | 0.8% | 1.4% | | |
| 800 | Acetone | 1.60 | 0.81 | 48.9% | 24.4% | 20.2% | 3.0% | 1.1% | 0.8% | 1.5% | | |
| 550 | Furfural | 0.65 | 0.00 | 43.1% | | 12.7% | 25.6% | | 15.0% | | | 3.5% |
| 550 | Furfural | 1.30 | 0.21 | 28.3% | | 22.1% | 31.2% | | 15.0% | | | 3.4% |
| 550 | Furfural | 1.60 | 0.26 | 29.5% | | 19.1% | 34.3% | | 12.6% | | | 4.5% |

While operation on acetone at approximately 600° C. and approximately 550° C., the $H_2$ production was quite high as compared to operation at approximately 800° C. It can be seen in Table 3 that on acetone at approximately 550 or approximately 600° C. there was no ethene or ethane produced, while at approximately 800 C there was a small quantity of each made. The methane and carbon monoxide production were also higher at approximately 800° C. The product mixture may change with change in specific composition of the cathode material.

When the cell was operated on furfural at approximately 550° C., there was no methane in the product gas stream and the $CO_2$ and ethane were much higher than the acetone runs. There was also no propane made, but pentane was made instead.

Example 3

Another ceria electrolyte cell was tested on furfural at 550° C. using two different current density values and at OCV. The furfural was vaporized at a temperature of approximately 50° C. with $N_2$ flowing and the steam had only $N_2$ as the carrier gas except for the OCV condition, which also had additional $H_2$. Table 4 below contains the GC results for the gas product at different current density and at OCV.

TABLE 4

Product gas analysis from electrochemical cell on furfural.

| Temp | Organic | Voltage | Current | H2 | CH4 | CO | CO2 | Ethene | Ethane | Acetylene | Propane | Butane | Pentane |
|---|---|---|---|---|---|---|---|---|---|---|---|---|---|
| 550 | Furfural | 1.30 | 0.06 | 3.0% | | 20.1% | 35.3% | 0.8% | | 1.2% | 36.6% | | 3.1% |
| 550 | Furfural | 1.60 | 0.10 | 1.8% | | 18.1% | 34.5% | 1.0% | | 1.0% | 40.9% | | 2.8% |
| 550 | Furfural | 0.76 | 0.00 | 96.7% | | 0.3% | 0.1% | | | | 2.9% | | |

The current densities for the same voltages were lower than those for the electrochemical cell of Example 2. Something to note is that in the electrochemical cell of Example 3, there was no ethane formed like in the electrochemical cell of Example 2, but a little acetylene and ethane and quite a bit of propane were formed.

Example 4

In one example, the electrochemical cell was another ceria electrolyte cell that was tested at approximately 550° C. using several different organics. It was independently tested on guaiacol, furfural, phenol, and syringol. The cell was tested at different current densities for each material except for furfural and syringol where it was tested at one condition to generate some condensate for Gas Chromatograph/Mass Spectrometer (GCMS) testing. All other materials were also left on test at one current density long enough to generate some condensate to evaluate using the GCMS. Nitrogen was used as the carrier gas for each chemical and $N_2$ with $H_2$ was used as a carrier gas for the steam, but at a reduced flow rate. The water temperature was lowered to approximately 50° C. from the temperature of approximately 82° C. used in previous cells to reduce the amount of available water to electrolyze. Table 5 contains the gas phase GC results for each condition.

TABLE 5

Output gas compositions using model compounds

| Temp | Organic | Voltage | Current | H2 | CH4 | CO | CO2 | Ethene | Ethane | Propane | Butane | Pentane |
|---|---|---|---|---|---|---|---|---|---|---|---|---|
| 550 | Guaiacol | 1.3 | 0.24 | 85.3% | 2.7% | 5.4% | 1.9% | 0.3% | 0.1% | 4.0% | 0.2% | 0.1% |
| 550 | Guaiacol | 1.39 | 0.36 | 85.1% | 2.9% | 5.4% | 1.8% | 0.3% | 0.2% | 3.9% | 0.3% | 0.1% |
| 550 | Guaiacol | 0.845 | 0 | 80.2% | 3.7% | 7.3% | 3.8% | 0.3% | 0.2% | 3.9% | 0.4% | 0.1% |
| 550 | Guaiacol | 1.55 | 0.748 | 83.0% | 3.3% | 6.3% | 1.8% | 0.3% | 0.2% | 4.6% | 0.3% | 0.1% |
| 550 | Furfural | 1.38 | 0.36 | 89.9% | | 3.7% | 2.2% | 0.1% | | 3.9% | | 0.2% |
| 550 | Furfural | 1.35 | 0.341 | 91.3% | | 2.4% | 2.3% | 0.1% | | 2.5% | | 1.4% |
| 550 | Phenol | 1.35 | 0.43 | 96.8% | | 0.9% | 0.5% | | | 1.9% | | |
| 550 | Phenol | 0.742 | 0 | 85.7% | | 1.6% | 5.6% | | | 7.1% | | |
| 550 | Phenol | 1.4 | 0.351 | 88.3% | | 1.7% | 4.8% | | | 5.2% | | |
| 550 | Phenol | 1.15 | 0.092 | 88.0% | | 1.7% | 5.0% | | | 5.3% | | |
| 550 | Phenol | 1.6 | 0.757 | 86.4% | | 1.6% | 5.5% | | | 6.4% | | |
| 550 | Syringol | 1.63 | 0.33 | 73.3% | 1.7% | 3.9% | 12.3% | 0.4% | | 8.3% | 0.2% | |
| 550 | Syringol | 1.69 | 0.142 | 71.3% | 2.1% | 5.0% | 12.2% | 0.3% | 0.1% | 8.7% | 0.2% | |

These materials all produced CO, $CO_2$ and propane in the gas phase products. The guaiacol and syringol were similar and also produced methane, ethane, ethane, and butane. The guaiacol did produce some pentane. The phenol only produced the CO, $CO_2$, and propane, while the furfural also produced ethane and pentane.

The liquid condensate from furfural, guaiacol and syringol tests included one or more of partially or fully deoxygenated liquid hydrocarbons such as: toluene, 2-cyclopenten-1-one, furfural, 2-5-dimethylfuran, methyl isobutyl ketone, p-xylene, 4,4-dimethyl-2-cyclopenten-1-one, styrene, anisole, benzaldehyde, phenol, benzofuran, salicylaldehyde, o-cresol, p-cresol, m-cresol, 2-hydroxybenzaldehyde, 2,3-dihydroxybenzaldehyde, 2-ethylphenol, 2-ethyl-6-methylphenol, naphthalene, 3-methoxyanisole, bicyclo[4,2,0]octa-1,3,5-triene, cyclopentanone, 2-methyl-2-cyclopenten-1-one, indene, 2,6-xylenol, 2,3-xylenol, 2,5-xylenol, dihydronaphthalene, guaiacol, 3-methyl-2-cyclopenten-1-one, catechol, 1-methylcatechol, 4-methylcatechol, 3-methylpyrocatechol, syringol, 3-methylcatechol, 1H-indenol, 1-indanone, dibenzofuran, 2-methylbenzofuran, phenyl methyl acetylene, 3-butenoic acid, 1-(2-furanyl) ethanone, 2,2'-bifuran, 5-methylfurfural, benzeneacetaldehyde, 2H-pyran-2-one.

Although the invention herein has been described in connection with described embodiments thereof, it will be appreciated by those skilled in the art that additions, modifications, substitutions, and deletions not specifically described may be made without departing from the spirit and scope of the invention as defined in the appended claims. It is therefore intended that the foregoing detailed description be regarded as illustrative rather than limiting, and that it be understood that it is the following claims, including all equivalents, that are intended to define the spirit and scope of this invention.

What is claimed:

1. A system for electrolytic reduction of a bio-mass material, comprising:

a pyrolyzer configured for receiving the bio-mass material and further configured for pyrolyzing the bio-mass material to generate at least a condensable bio-mass vapor;

an electrochemical deoxygenation unit in fluid communication with the pyrolyzer for receiving the condensable bio-mass vapor from the pyrolyzer, the electrochemical deoxygenation unit including:

an anode configured for residing in an oxidizing environment;

a cathode comprising a first surface and a second surface;

a fluid conduit adjacent to a first surface of the cathode, the fluid conduit adapted to convey the condensable bio-mass vapor such that the condensable bio-mass vapor contacts the first surface of the cathode;

an oxygen-ion conducting membrane located between the second surface of the cathode and the anode, and further separating the anode from the fluid conduit, wherein the fluid conduit and the oxygen-ion conducting membrane are configured such that the condensable bio-mass vapors will not contact the anode; and a power source that applies an electric potential between the cathode and anode;

an oxygen conveyance outlet for releasing oxygen generated from the electrochemical deoxygenation unit; and a hydrocarbon conveyance outlet for releasing hydrocarbon vapors generated from the electrochemical deoxygenation unit; and a condenser downstream of the electrochemical deoxygenation unit and in fluid communication with the electrochemical deoxygenation unit via the hydrocarbon conveyance outlet, the condenser configured to condense the hydrocarbon vapors generated from the electrochemical deoxygenation unit into a mixture of hydrocarbon gases and liquids.

2. The system of claim 1, further comprising an electrolytic layer, wherein the electrolytic layer comprises zirconia or ceria doped with trivalent cations.

3. The system of claim 2, wherein the trivalent cations are selected from yttria, scandia, ytterbia, samaria, gadolinia, and combinations thereof.

4. The system of claim 1, further comprising an electrolytic layer, wherein the electrolytic layer comprises strontium and magnesium doped lanthanum gallate.

5. The system of claim 1, wherein the anode comprises doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, nickel-doped zirconia, nickel-doped ceria, nickel, cobalt, molybdenum, ruthenium, platinum, praseodymium, cerium, other elements from the rare earth element group or from the precious metal group, or combinations thereof.

6. The system of claim 1, wherein the cathode comprises doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, nickel-doped zirconia, nickel-doped ceria, nickel, cobalt, molybdenum, ruthenium, platinum, praseodymium, cerium, other elements from the rare earth element group or from the precious metal group, or combinations thereof.

7. A system for electrolytic reduction of a bio-mass material, comprising:

a pyrolyzer configured for receiving the bio-mass material and further configured for pyrolyzing the bio-mass material to generate at least a condensable bio-mass vapor;

an electrochemical deoxygenation unit in fluid communication with the pyrolyzer for receiving the condensable bio-mass vapor from the pyrolyzer, the electrochemical deoxygenation unit including:

an anode configured for residing in an oxidizing environment, the anode having a first power receptacle;

a cathode comprising a first surface and a second surface, the cathode having a second power receptacle, wherein the first and second power receptacles are configured for receiving power that applies an electric potential between the cathode and the anode;

a fluid conduit adjacent to a first surface of the cathode, the fluid conduit adapted to convey the condensable bio-mass vapor such that the condensable bio-mass vapor contacts the first surface of the cathode;

an oxygen-ion conducting membrane located between the second surface of the cathode and the anode, and further separating the anode from the fluid conduit, wherein the fluid conduit and the oxygen-ion conducting membrane are configured such that the condensable bio-mass vapors will not contact the anode; and an oxygen conveyance outlet for releasing oxygen generated from the electrochemical deoxygenation unit; and a hydrocarbon conveyance outlet for releasing hydrocarbon vapors generated from the electrochemical deoxygenation unit; and a condenser downstream of the electrochemical deoxygenation unit and in fluid communication with the electrochemical deoxygenation unit via the hydrocarbon conveyance outlet, the condenser configured to condense the hydrocarbon vapors generated from the electrochemical deoxygenation unit into a mixture of hydrocarbon gases and liquids.

8. The system of claim 7, further comprising an electrolytic layer, wherein the electrolytic layer comprises zirconia or ceria doped with trivalent cations.

9. The system of claim 8, wherein the trivalent cations are selected from yttria, scandia, ytterbia, samaria, gadolinia, and combinations thereof.

10. The system of claim 7, further comprising an electrolytic layer, wherein the electrolytic layer comprises strontium and magnesium doped lanthanum gallate.

11. The system of claim 7, wherein the anode comprises doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, nickel-doped zirconia, nickel-doped ceria, nickel, cobalt, molybdenum, ruthenium, platinum, praseodymium, cerium, other elements from the rare earth element group or from the precious metal group, or combinations thereof.

12. The system of claim 7, wherein the cathode comprises doped lanthanum manganite, doped lanthanum cobaltite, doped lanthanum cobalt ferrite, electron conducting ceramics belonging to the family of perovskites or pyrochlores, oxygen ion-electron conducting ceramics belonging to the family of perovskites or pyrochlores, nickel-doped zirconia, nickel-doped ceria, nickel, cobalt, molybdenum, ruthenium, platinum, praseodymium, cerium, other elements from the rare earth element group or from the precious metal group, or combinations thereof.

13. The system of claim 7 further comprising a power source that applies an electric potential between the cathode and anode.

14. The system of claim 7, wherein the pyrolyzer configured for pyrolyzing the bio-mass material to generate the at least a condensable bio-mass vapor is further configured to generate steam.

15. The system of claim 14, wherein hydrogen is provided to the cathode in situ from electrolysis of the steam.

16. The system of claim 1, wherein the pyrolyzer configured for pyrolyzing the bio-mass material to generate the at least a condensable bio-mass vapor is further configured to generate steam.

17. The system of claim 16, wherein hydrogen is provided to the cathode in situ from electrolysis of the steam.

* * * * *